US005170599A

United States Patent [19]

Knight

[11] Patent Number: 5,170,599

[45] Date of Patent: Dec. 15, 1992

[54] DOME BUILDING STRUCTURE

[75] Inventor: Brian V. Knight, New Hartford, N.Y.

[73] Assignee: Dome Corporation of America, Montclair, N.J.

[21] Appl. No.: 675,186

[22] Filed: Mar. 26, 1991

[51] Int. Cl.[5] ..... E04B 1/32

[52] U.S. Cl. ..... 52/81

[58] Field of Search ..... 52/81, 82, DIG. 10, 52/80

[56] References Cited

U.S. PATENT DOCUMENTS 4,285,174 8/1981 Knight ..... 52/81

4,686,801 8/1987 Ericksson ..... 52/81

*Primary Examiner*—David A. Scherbel

*Assistant Examiner*—Creighton Smith

*Attorney, Agent, or Firm*—D. Peter Hochberg; Mark Kusner; Louis J. Weisz

[57] ABSTRACT

A self supporting dome structure comprised of a plurality of rings connected one upon another, each of the rings approximating a conical frustum with successively higher rings having lower angles of inclination. Many of the rings are formed of a plurality of individual, flat panel, each of which includes a flat rectilinear top plate member, a flat rectilinear bottom plate member and opposed flat rectilinear side members, the side member converging inwardly from the bottom member to the top member. The structure includes at least one first transitional ring having a plurality of panels, each panel of the transitional ring including upwardly converging rectilinear side members, a concave top plate member defining an upper conical surface which slopes inwardly, and a flat rectilinear bottom plate, and at least one second transitional ring having a plurality of panels, each panel of the second transitional ring including upwardly converging rectilinear side members, a flat rectilinear top plate member and a convex bottom member defining a lower conical surface which slopes inwardly. The rings above the transitional ring having fewer panels than the rings below the transitional rings.

15 Claims, 13 Drawing Sheets

DOME BUILDING STRUCTURE

FIELD OF THE INVENTION

The present invention relates to building structures and more particularly to a dome building structure comprised of a plurality of individual panels. The present invention is particularly applicable as a barn, silo or the like for storage of granular material, bulk or prepackaged, or as a place of assembly.

BACKGROUND OF THE INVENTION

Various building structures for the storage of granular material have been proposed. One type of building structure which lends itself to such use, is a segmented building structure, which is generally comprised of a plurality of factory-manufactured panels which are secured together to form a dome-shaped structure which diminishes in size from bottom to top. Examples of such structures may be found in U.S. Pat. Nos. 3,820,292 to Fitzpatrick; 4,665,664 to Knight and 4,686,801 to Eriksson, et al. Such structures find wide acceptance as storage facilities for granular material due primarily to their relatively inexpensive cost compared to other type of building structures.

A problem with such structures, however is that structural limitations inherent in their designs generally limit their size and application. In this respect, the structure shown in U.S. Pat. No. 3,820,292 is essentially comprised of a plurality of wedge-shaped sectors which converge upwardly from the base of the building to a point at the top of the building. Each sector is basically comprised of a plurality of individual panels, each of which has straight side members which converge from a bottom plate member to a smaller top plate member. In other words, the sides of each panel slope inwardly from the base to form a trapezoidal shape.

While the disclosed design has proved commercial successful, its inherent design limitations basically restrict sizes of structures built thereby. In this respect, when manufacturing a structure, it is desirable to both utilize commercially available construction material, and to minimize fabrication time. To maximize use of commercial grade material, the largest panel in the structure (i.e. the lowest panel at the base of the structure) is preferably dimensioned to have a length and height which correspond to the length and width of the largest commercially available construction material. Of course, the size (diameter) of a dome structure may be increased by increasing the number of the base or bottom panels (it being understood that increasing the diameter increases the height of the resulting dome). With each additional base panel however, a new sector is created and the panels in such sector become successively smaller as they approach the upper end of the sector near the peak of the dome. It is these smaller panels located near the peak of the structure which are costly to produce in that their size does not economically utilize available construction materials.

U.S. Pat. No. 4,665,664 to Knight discloses a dome building structure comprised of convex panels. The convex panels are similar to those shown in the Fitzpatrick U.S. Pat. No. 3,820,292 in that the panels are generally trapezoidal in shape and include opposed upwardly converging side members. Unlike the panels disclosed in the Fitzpatrick patent, however, the outer edges of the top and bottom plate members are curved to form panels which are outwardly convexed from side-to-side.

While these conical panels provide greater structural strength than those disclosed in the Fitzpatrick patent and thus would be preferable when building larger domes, the structure is nevertheless limited in its application for the same reasons set forth above with respect to the Fitzpatrick dome, i.e. the larger the dome, the greater the number of sectors and the larger the number of panels, (large and small alike) which must be fabricated. In addition, the fabrication of the outer edges and construction of the curved panels increases the overall cost of such structures.

U.S. Pat. No. 4,686,801 to Eriksson, et al. shows yet another dome structure comprised of a plurality of individual panels. Each panel includes an outer surface which is convexed from side-to-side. While these panels have upwardly and inwardly converging rectilinear sides, they also include an upwardly concave top plate member and a downwardly convex bottom plate member. More specifically, the top and bottom plate members have outer edges which are outwardly curved and at the same time are bowed, concavely and convexly respectively to form essentially conical surfaces. In this respect, the top and bottom plate members of the panels forming a given ring thus define annular conical surfaces. Importantly, these mating conical surfaces permit panels above and below to be offset, wherein joining lines formed by adjacent panels can be staggered from one ring to another to strengthen the resulting structure. A major drawback of the disclosed structure, however, is the fabrication cost involved in producing such panels. As will be appreciated, the cost of producing such concave/convex curved panels is substantially greater than the cost of producing a flat panel.

The present invention overcomes the foregoing limitations inherently found in dome structures known heretofore and provides a building structure which effectively utilizes the cost efficiency of flat panels, but which reduces the number of small panels required near the peak of such structures.

SUMMARY OF THE INVENTION

In accordance with the present invention, there is provided a self supporting dome structure comprised of a plurality of rings connected one upon another, each of said rings approximating a conical frustum with successively higher rings having lower angles of inclination. Many of the rings are formed of a plurality of individual, flat panels, each of which includes a flat rectilinear top plate member, a flat rectilinear bottom plate member and opposed flat rectilinear side members, the side members converging inwardly from the bottom member to the top member. The structure includes at lease one first transitional ring having a plurality of panels, each panel of the first transitional ring including upwardly converging rectilinear side members, a concave top plate member defining an upper conical surface which slopes inwardly, and a flat rectilinear bottom plate, and at least one second transitional ring having a plurality of panels, each panel of said second transitional ring including upwardly converging rectilinear side members, a flat rectilinear top plate member and a convex bottom member defining a lower conical surface which slopes inwardly.

In accordance with another aspect of the present invention, there is provided a self supporting dome structure comprised of a plurality of vertically-adjacent, upwardly and inwardly inclining, generally annular rings stacked one upon another. The stacked rings include a first set of rings, a second set of rings and a pair of transitional rings disposed between the first set and the second set of rings. The first set of rings is comprised of a predetermined number of horizontally-adjacent flat panels, each of which includes a rectilinear top plate member, a rectilinear bottom plate member and opposed rectilinear side members converging inwardly from the bottom plate member to the top plate member. The second set of rings is disposed above the first set of rings and are smaller in diameter than the first set of rings and have a lesser number of horizontally-adjacent flat panels. Each panel in a ring in the second set includes a rectilinear top plate member, a rectilinear bottom plate member, and opposed rectilinear side members converging inwardly from the bottom plate member to the top plate member. The pair of first and second transitional rings are disposed between the first set of rings and the second set of rings. The first transitional ring is comprised of horizontally-adjacent panels equal in number to the number of panels in the first set of rings and has a generally upward facing annular surface. The second transitional ring is comprised of horizontally-adjacent panels equal in number to the number of panels found in a ring in the second set of rings and has a generally downward facing annular surface dimensioned and oriented to engage the annular surface on the first transitional ring.

In accordance with another aspect of the present invention, there is provided a panel for use in a self supporting building structure which is formed from a plurality of vertically-adjacent upwardly and inwardly inclining multi-panel rings stacked one on another. The panel is comprised of a generally trapezoidal structural frame including an elongated, top plate member having a flat upper surface, a straight longitudinal outer edge facing in a first direction and an inner edge projecting in the opposition direction. An elongated bottom plate member which is longer than the top plate member is provided and includes an outwardly arcuate outer edge generally facing in the first direction, an inner edge projecting in the opposite direction, and a lower convex generally conical surface, the bottom plate member being spaced apart from the top plate member wherein the upper surface on the top plate member and the lower surface on the bottom plate member face in generally opposite directions and wherein the respective ends of the top and bottom plate member are generally in registry with and equally spaced from each other. A pair of elongated side members secure the ends of the top plate member to the corresponding ends of the bottom plate member. The member converge from the bottom member to the top member, and each has a flat outer edge facing generally in the first direction. The flat outer edges of the side member are in surface alignment with the outer edges of the top and bottom plate members. An outer structural sheet is fastened to the trapezoidal structure frame, and spans the outer edges of the top and bottom plates and the side members.

In accordance with another aspect of the present invention, there is provided a panel for use in a self supporting building structure which is formed from a plurality of vertically-adjacent, upwardly and inwardly inclining multi-panel rings stacked one on another. The panel is comprised of a generally trapezoidal structural frame including an elongated bottom plate member having a flat lower surface, a straight longitudinal outer edge facing in a first direction and an inner edge projecting in the opposite direction. An elongated top plate member which is shorter than the bottom plate member is provided and includes an outwardly arcuate outer edge generally facing in the first direction, an inner edge projecting in the opposite direction, and an upper concaved, generally conical surface, the top plate member being spaced apart from the bottom plate member wherein the upper surface on the top plate member and the lower surface on the bottom plate member face in generally opposite directions and wherein the respective ends of the top and bottom plate member are generally in registry with and equally spaced from each other. A pair of elongated side members secure the ends of the top plate member to the corresponding ends of the bottom plate member and has a flat outer edge facing generally in the first direction, the flat outer edges of the side member being in surface alignment with the outer edges of the top and bottom plate members. An outer structural sheet is fastened to trapezoidal structure frame and spans the outer edges of the top and bottom plates and the side members.

In accordance with another object of the present invention there is provided a roof structure comprised of a plurality of like dimensioned, generally triangular trusses radially extending from a central axis. The trusses are equispaced about the central axis and have first end adjacent the axis and a second end defining the outer edge of the roof structure. Each truss includes a downward sloping upper beam, a downward sloping lower beam, the lower beam having a smaller angle of inclination than the upper beam wherein the beams intersect and a plurality of vertical support member secured to the upper and lower beams. Sheet material spans and is secured to the upper surface of the upper beams.

A primary object of the present invention is to provide a self supporting structure comprised of a plurality of vertically-adjacent, upwardly and inwardly inclining generally annular, multi-panel rings stracked one on another wherein the number of panels in upper rings can be fewer than in rings therebelow.

Another object of the present invention is to provide a self supporting structure as described above wherein the panels used in forming the structure are sized to maximize use of commercially available building material.

Another object of the present invention is to provide a self supporting structure as described above which minimizes the number of panels required in such a structure.

A still further object of the present invention is to provide a self supporting structure as described above which increases the size of structures which can be formed substantially of flat panels while reducing the number of panels required therein.

Another object of the present invention is to provide a truss-like roof structure for a self-supporting structure as described above, which cover is dimensioned to complete and enclose the upper portion of such structure.

A still further object of the present invention is to provide a cover as described above which reduces the cost of such structures.

These and other objects and advantages will become apparent from a reading of the following description considered with the drawings, and the appended claims.

BRIEF DESCRIPTION OF THE DRAWINGS

The invention may take physical form in certain parts and arrangement of parts, embodiments of which is described in detail in the specification and illustrated in the accompanying drawings which form a part hereof and wherein.

DETAILED DESCRIPTION OF THE PREFERRED EMBODIMENT

Figure 1:
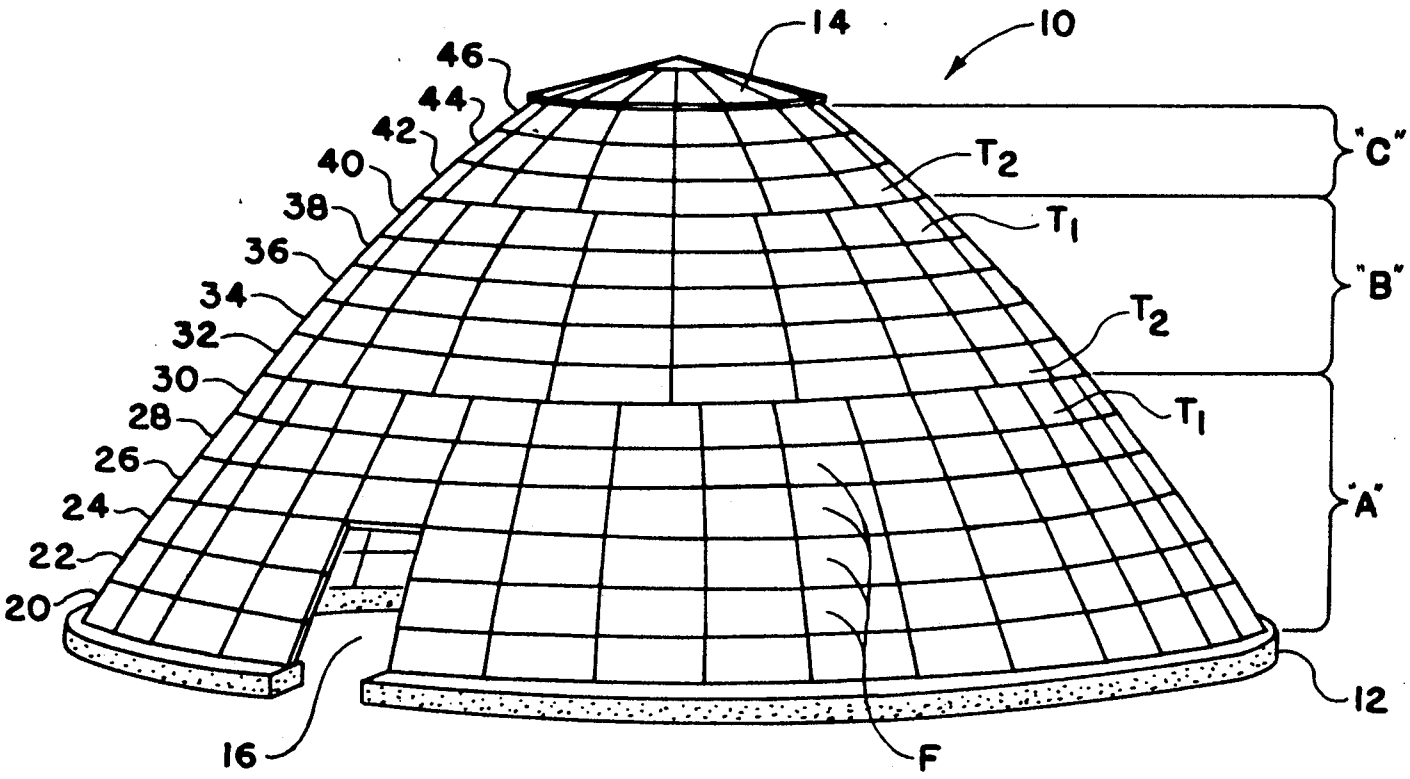
FIG. 1 is a prospective view of a self supporting dome structure illustrating a preferred embodiment of the present invention.

Referring now to the drawings wherein the showing is for the purpose of illustrating the preferred embodiments of the invention only, and not for the purpose of limiting same, FIG. 1 shows a self supporting dome structure 10 according to the present invention. Structure 10 is dimensioned to rest upon an annular pad or wall 12, and is generally comprised of a plurality of rings, each of which conforms closely to a frustum of a cone. In the embodiment shown, structure 10 includes fourteen rings which are designated 20, 22, 24, 26, 28, 30, 32, 34, 36, 38, 40, 42, 44 and 46 in the drawings. Each ring in structure 10 inclines generally inwardly and upwardly at a progressively more pronounced angle of inward inclination toward the top. In the embodiment shown, the uppermost end of structure 10 is capped by a structural cover 14 according to one aspect of the present invention.

Each ring in structure 10 is comprised of a plurality of individual panels. In the embodiment shown, rings 20, 22, 24, 26, 28, 34, 36, 38, 44 and 46 are comprised of panels which are generally flat. Hereinafter, flat panels, irrespective of size or shape, shall be referred to as and designated, "F" in the drawings. Rings 30, 32, 40, and 42 are comprised of what shall hereinafter be referred to as "transitional panels" and which according to the present invention are of two types which are dimensioned to interact with each other. These transitional panels shall be discussed and described in greater detail below, but at the present time shall be identified as transitional panels $T_1$ and $T_2$, . . . $T_1$ designating a first type of transitional panel and $T_2$ designating a second type of transitional panel. In the embodiment shown, rings 30 and 40 are comprised of the first type of transitional panel $T_1$, while rings 32 and 42 are comprised of the second type of transitional panel $T_2$.

In the course of the design of structure 10 and the manufacture of panels F, $T_1$ and $T_2$, desired angles of inward inclination of bottom ring 20 and each superjacent ring are selected. The inclination desired for successive rings may depend upon, for example, the angle of repose of a bulk granular or particulate material to be stored within structure 10. The specific angle of inclination for a particular ring and dimensions of panels used therein are selected and calculated based upon a conventionally known, established engineering principles, generally known to those skilled in the art. With respect to the design of the individual panels, however, according to the present invention, the panels are preferably dimensioned to maximize utilization of sheets of standard sized plywood or other sheet material used in forming same. Accordingly, the maximum dimensions of any panel is preferably determined in light of the largest commercial sheet material available and maximum utilization thereof.

To this end, according to the present invention, structure 10 includes at least two contiguous sets of rings, wherein each of the rings in a particular set includes (or is dimensioned to include) an equal number of panels. In the embodiment shown, structure 10 includes three contiguous sets of rings, which sets are designated "A", "B" and "C" in the drawings. Each ring within a given set contains an equal number of panels, the exception being rings 20, 22 and 24 in set "A" wherein panels have been removed to create an access opening 16 into the interior of structure 10. In this respect, rings 20, 22 and 24 are nevertheless "dimensioned" so as to be able to include a number of panels equal to the other rings in set "A". Importantly, rings in superjacent sets include fewer panels therein and each contiguous set "A", "B" and "C" includes at least one ring formed from transitional panels $T_1$ or $T_2$. In the embodiment shown, set "A" includes one ring 30 of transitional panels $T_1$. Set "B" includes two rings, i.e. rings 32 and 40 of transitional panels $T_2$, $T_1$ respectively and set "C" includes a ring 42 comprised of transitional panels $T_2$.

Figure 7:
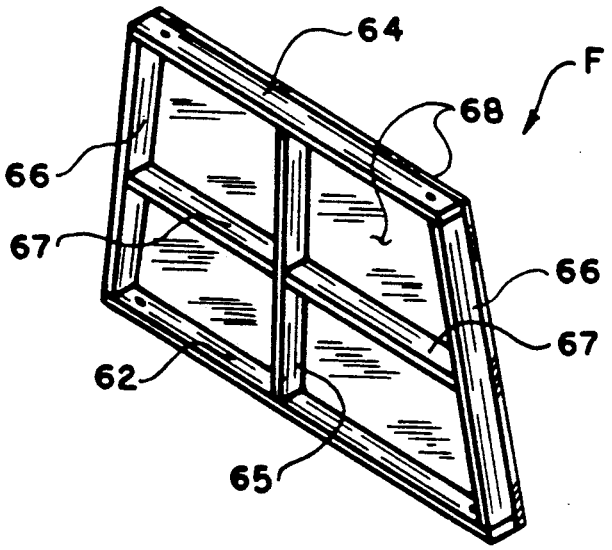
FIG. 7 is a prospective, interior view of a flat panel which can be used in construction of a structure as shown in FIG. 1.

Referring now to rings 20, 22, 24, 28, 34, 36, 38, 44 and 46, each ring is comprised of a plurality of flat panels F. Panels F in each of the foregoing rings are generally similar in construction and design and therefore a description of one panel generally describes other flat panels irrespective of size and/or dimension. In this respect, each panel F (best seen in FIG. 7) is basically comprised of a rectilinear bottom plate member 62 spaced apart from a shorter rectilinear top plate member 64. Two opposed straight side members 66 converge from bottom plate member 62 to top plate member 64. Side members 66 and top and bottom plate members 64, 62 are joined at their respective ends to form a generally trapezoidal-shaped framework. Top and bottom plate members 64, 62 in an assembled structure 10 form oblique angles to a horizontal plane, and therefore the ends of side members 66 are cut at angles to facilitate a tight fit to top and bottom plate members 62, 64. Side members 66 are also angled inwardly such that their sides are generally oriented toward the central axis of structure 10. A structural sheet 68, which is preferably plywood or fiberglass, is fit over the outer edges of the trapezoidal framework and is attached to it, for instance by nailing and/or gluing. In FIG. 7, flat panel F is shown having a vertical reinforcing plate member 65 and a pair of horizontal reinforcing plate members 67. Reinforcing plate members 65, 67 are typically added to large panels as structural reinforcing and to provide additional surface area for attachment of sheet 68. Hereinafter, when referring to panels F, $T_1$ and $T_2$, reinforcing plate members may or may not be shown in the drawings but will not be discussed in the specification, it being understood that use of such reinforcing plate members in a given panel is based upon the size of the panel and the need for reinforcing same, and that such determination is within the ability of those skilled in the art.

Panels F can be joined to one another by conventional fastening means, for example by standard nuts, washers and bolts, extending through coaxial holes drilled in side members 66 and top and bottom plate members 64, 62. Like panels F are joined side-to-side and thereby substantially define a shape of a conical frustum. The upper and lower ends of rings formed of flat panels generally define a faceted circle formed from the rectilinear top and bottom plate member of the panels forming the ring. Frustums of decreasing diameter are joined as the building increases in height. Flat panels F such as those heretofore described are conventionally known (see U.S. Pat. No. 3,820,292 to Fitzpatrick) and in and of themselves form no part of the present invention.

As indicated above, lower ring 20 is preferably comprised of flat panels F and dimensioned to rest upon an annular pad or wall 12, which is preferably formed of reinforced concrete. In the drawings, the upper surface of wall 12 is shown as being generally flat but may be dimensioned to include an inwardly and downwardly oriented surface to receive bottom plate member 62 of panel F of ring 20. Cast in place studs or other anchors are preferably spaced uniformly around the circumference of the upper surface of wall 12 to pass through holes drilled through bottom plate members 62 of panels F of ring 20, nuts being threaded onto the studs to engage the upper side of bottom plate members 62 and secure panels F and ring 20 in place. Wall 12 is dimensioned to receive the downward and outward thrust imposed by the weight of the rings stacked thereon and the upper surface of wall 12 is selected so that the wall 12 stably receives this thrust.

Figure 2:
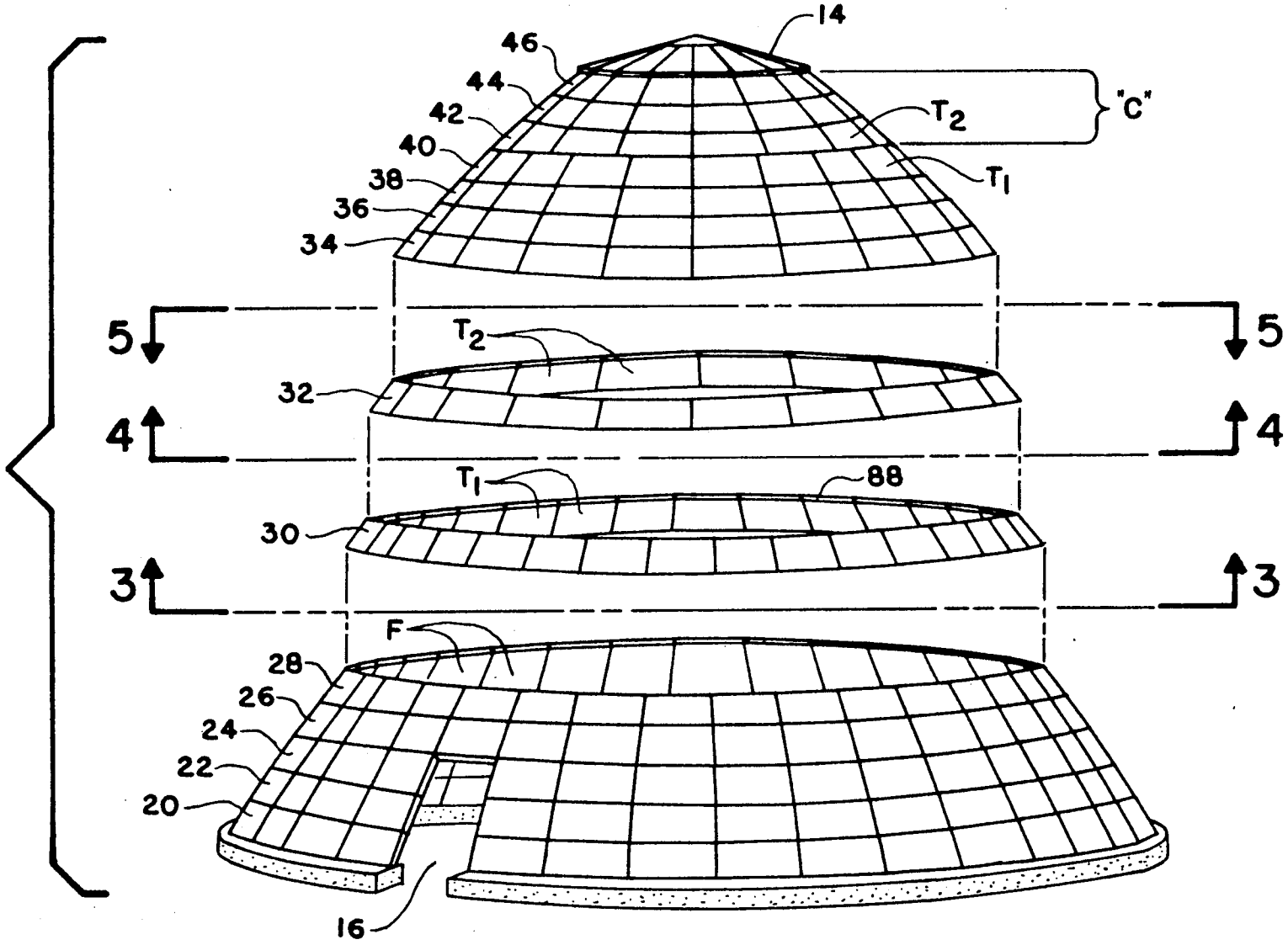
FIG. 2 is an exploded view of the self supporting dome structure shown in FIG. 1.
Figure 9:
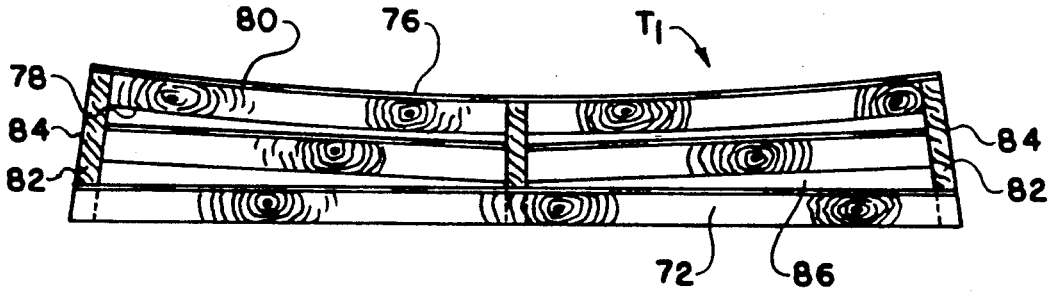
FIG. 9 is a view taken along lines 9—9 of FIG. 8.
Figure 8:
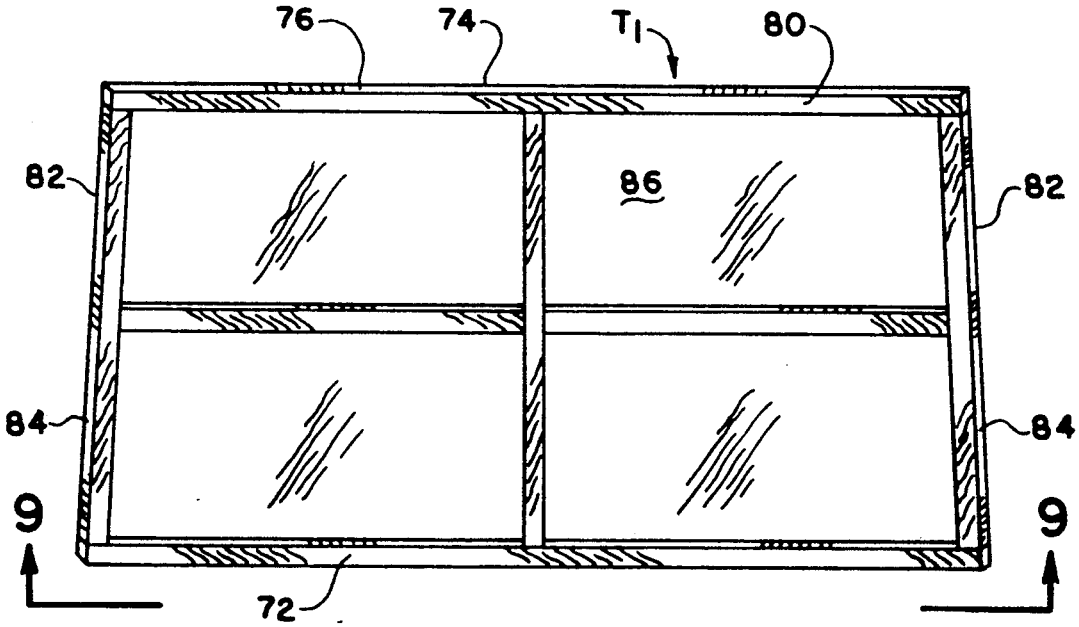
FIG. 8 is an elevational view of a first type of transitional panel illustrating another aspect of the present invention.

Referring now to FIGS. 1 and 2, of the rings forming set "A" i.e., rings 20, 22, 24, 26 and 28, are comprised of flat panels F as described above. Each of these rings has the same number of panels and the sides of each panel are aligned with the panels above and below, wherein superjacent panels are progressively narrower than the panel therebelow. The uppermost ring in set "A" is ring 30 which is formed from transitional panels $T_1$. Ring 30 provides a transition between set "A" and set "B" and facilitates set "B" having fewer panels than rings in set "A". A transitional panel $T_1$ is illustrated in FIGS. 8 and 9. Transitional panel $T_1$ is basically comprised of a rectilinear bottom plate member 72 dimensioned to correspond to top plate member 64 of flat panel F in ring 28. Bottom plate member 72 is spaced apart from a shorter, bowed top plate member 74, having a concaved upper surface 76 and a forwardly (outward relative to building structure 10) convexly profiled front edge 78 and a concaved rear edge 80..Top plate member 74 is shorter in length than bottom plate member 72 depending upon the angle of inward inclination it is intended to achieve for the frustum, and hence on the difference in circumference between the lower and upper edges of the frustum. A pair of rectilinear side members 82 connect the ends of top plate member 74 to the ends of bottom plate member 72. The upper and lower ends of each side member 82 are preferably machined to conform to the inner surface of the ends of top and bottom plate members 74, 72 respectively. Side members 82 converge inwardly and upwardly and are disposed such that their outer surfaces 84 are oriented radially with respect to the center line of structure 10, such that sides of adjacent panels $T_1$ abut and mate when a plurality of like panels $T_1$ are assembled side-by-side to form a ring. A sheet 86, preferably of plywood or fiberglass, is fit over the outer edges of top and bottom plate members 74, 72 and side members 82. Transitional panels $T_1$ is held together by mechanically fastening together adjoining parts, for example, by nailing and/or gluing. The front edges of the respective components are preferably machined to conform to the angle between them and sheet 86.

Figure 3:
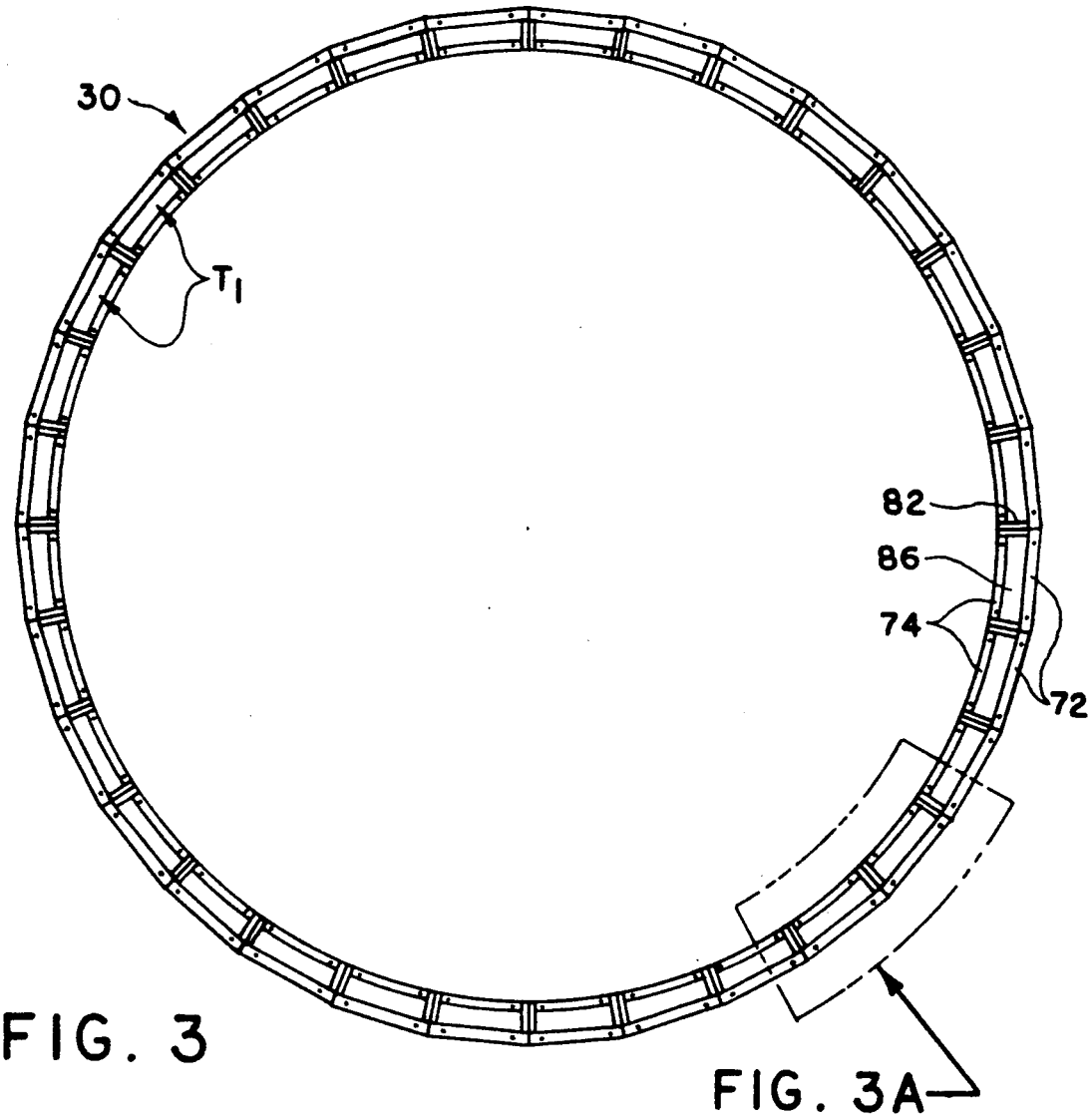
FIG. 3 is a sectional view taken along the lines 3—3 of FIG. 1.
Figure 3A:
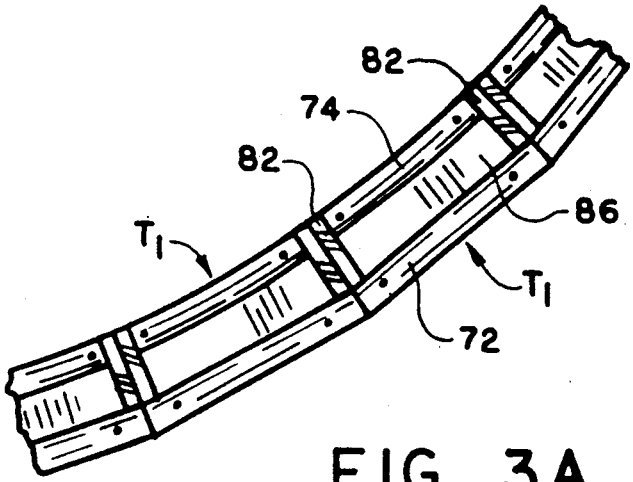
FIG. 3A is an enlarged view of area 3A shown in FIG. 3.
Figure 4:
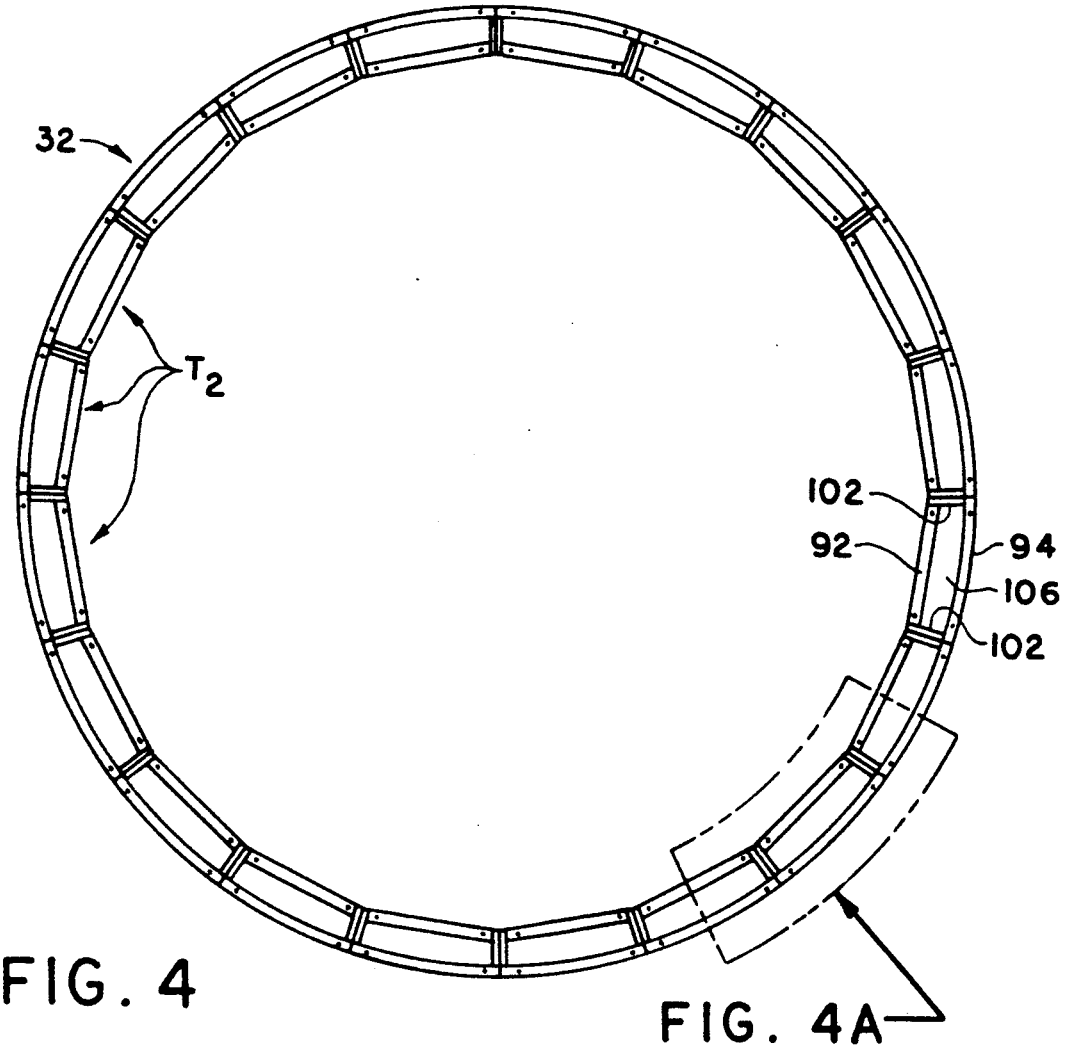
FIG. 4 is a view taken along lines 4—4 of FIG. 2.
Figure 4A:
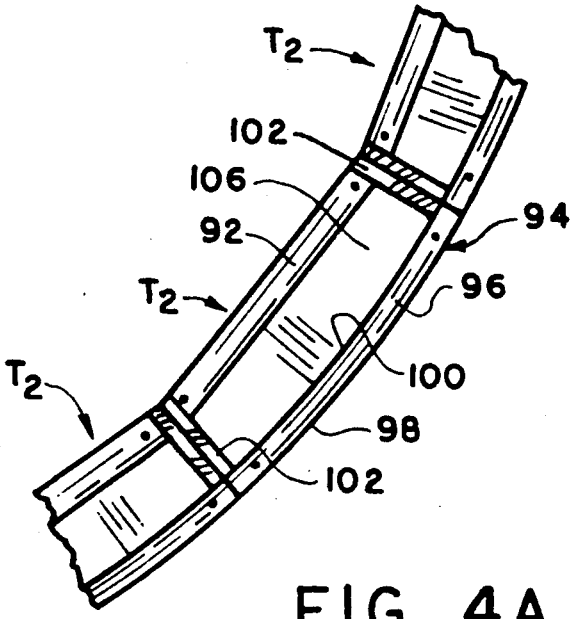
FIG. 4A is an enlarged view of area 4A of FIG. 4.
Figure 5:
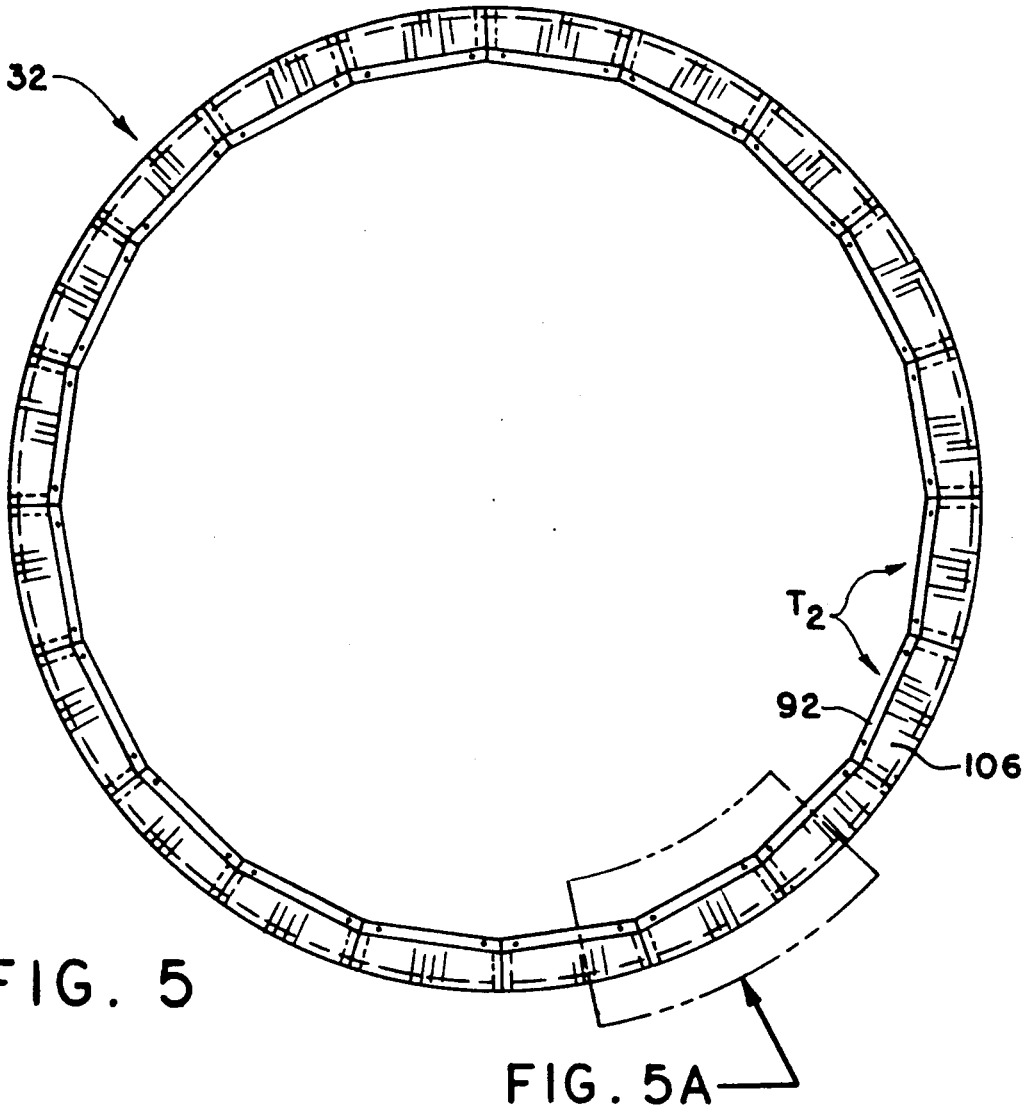
FIG. 5 is a view taken along lines 5—5 of FIG. 2.
Figure 5A:
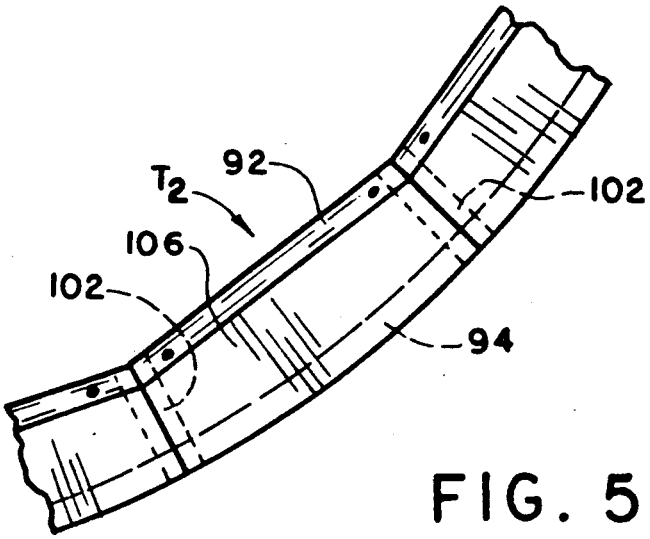
FIG. 5A is an enlarged view of area 5A of FIG. 5.

In the construction of transitional panels $T_1$, top plate member 74 is bowed and inclined such that concave upper surface 76 is generally conical. Like transitional panels $T_1$ are joined side-to-side by conventional fastening means and thereby form ring 30 as illustrated in FIGS. 3 and 3A which are bottom views thereof. As shown in FIGS. 3 and 3A, bottom plate members 72 of transitional panels $T_1$ assume a faceted circular profile whereas top plate members 74 generally assume a smooth circular profile. Importantly, the upper surfaces 76 of transitional panels $T_1$ of ring 30 together define a narrow, dished, annular surface 88 about the top of ring 30 (best seen in FIG. 2), which surface 88 conforms to a part of an inverted cone having its apex at the vertical axis of assembly 10. According to the present invention, the faceted lower end of ring 30 is dimensioned to set upon the faceted upper end of ring 28 which is formed of flat panels F, while conical upper annular surface 88 of ring 30 is dimensioned to support ring 32.

Ring 32 which is disposed immediately above ring 30 in structure 10 is the lowest most ring in set "B". Of the rings forming set "B", rings 34, 36 and 38 are comprised of flat panels F constructed as previously described. Uppermost ring 40 of set "B" is comprised of a transitional panel $T_1$ constructed in a manner as previously described wherein ring 40 includes a narrow, dished, annular surface about the upper surface thereof, which annular surface is smaller in diameter and has a greater angle of inclination.

Figure 11:
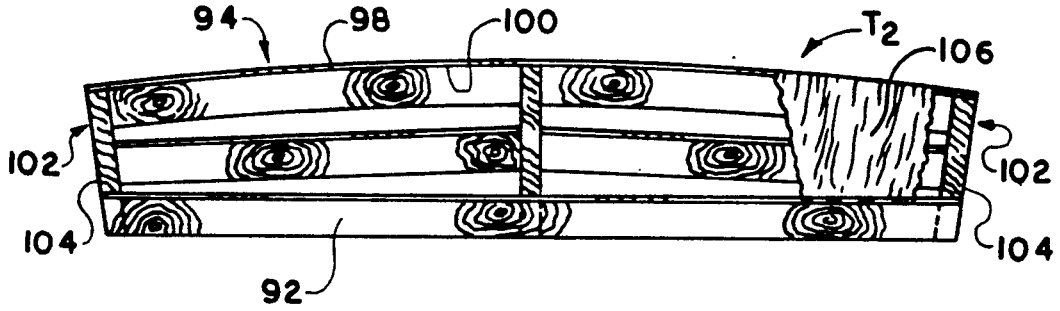
FIG. 11 is a view taken along lines 11—11 of FIG. 10.
Figure 10:
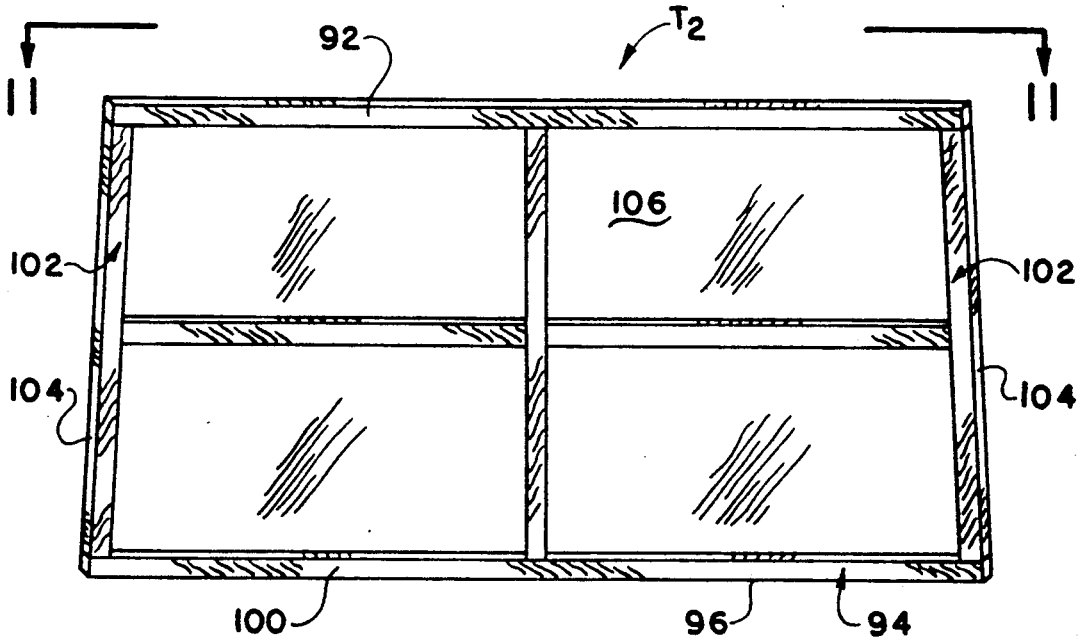
FIG. 10 is an elevational view of a second type of transitional panel according to another aspect of the present invention.

Ring 32 is comprised of the second type of transitional panel $T_2$, best illustrated in FIGS. 10 and 11. Transitional panel $T_2$ is generally comprised of a rectilinear top plate 92 spaced apart from a longer downward by bowed bottom plate member 94, having a convex lower surface 96, a forwardly (outwardly) convexly profiled front edge 98 and a concaved rear edge 100. According to the present invention, convex lower surface 96 of bowed bottom plate member 94 is conical in shape. Top plate members 92 is shorter in length than bottom plate member 94 and depending upon the angle of inward inclination, it is intended to achieve for the frustum and hence on the difference in circumference between the upper and lower edges of the frustum. A pair of rectilinear side members 102 connect the ends of top plate member 92 to the ends of bottom plate member 94, the upper and lower ends of each side member 102 being preferably machined to conform to the inner surface of the edges of top plate member 92 and bottom plate member 94. Side members 102 converge inwardly and upwardly, and are disposed such that their outer sides 104 are oriented radially with respect to the center line of structure 10 wherein the sides of adjacent panels $T_2$ abut when a plurality of like transitional panels $T_2$ are assembled side-by-side to form a ring. A sheet 106, preferably of plywood or fiberglass, is fit over the outer edges of top plate member 92, bottom plate member 94 and side members 102 and secured thereto by nailing and/or gluing. Transitional panel $T_2$ is held together by mechanically fastening together adjoining parts, for example, by nailing and/or gluing. Typically the front edges of the members are preferably machined to conform to the angle between them and sheet 106. Ring 32, best seen in FIGS. 4, 4A, 5 and 5A, is formed from like transitional panels $T_2$ which are joined side-to-side by conventional fastening means, preferably nuts and bolts. The upper end of ring 32 which is formed by top plate members 92 of transitional panels $T_2$ generate a faceted circular profile (best seen in FIGS. 5 and 5A) dimensioned to support the faceted lower end of ring 34 which is comprised of flat panels F. The lower end of ring 34 (best seen in FIGS. 4 and 4A), which is formed by bottom plate members 94 of transitional panels $T_2$, generate a generally circular profile. In this respect, bottom surfaces 96 of transitional panels $T_2$ forming ring 32 define a downward facing, narrow, dished annular surface 108 conforming to an inverted cone having its apex along the centerline of structure 10. Downward facing conical surface 108 of ring 32 is dimensioned to set upon upward facing annular surface 88 of ring 30. Thus, rings 30 and 32, formed respectively from transitional panels $T_1$ and $T_2$ mate along matching conical surfaces. Transitional panels $T_1$ and $T_2$, in rings 30, 32 respectively, thus provide a transition from the flat panels F in ring 28 of set "A" and flat panels F in ring 34 of set "B". Importantly, because rings 30 and 32 abut along matching conical surfaces, ring 32 is not confined to have the same number of panels as ring 30 as would be the case with abutting rings formed of flat panels F which would mate along a faceted surface. In other words, the panels in rings in set "B" are not restricted in shape or size by the panels in set "A". Consequently, rings in superjacent sets can have fewer and, larger panels therein. The conical transition surface between rings 30 and 32 eliminates the need for sectors formed by flat panels to be continued.

Figure 6:
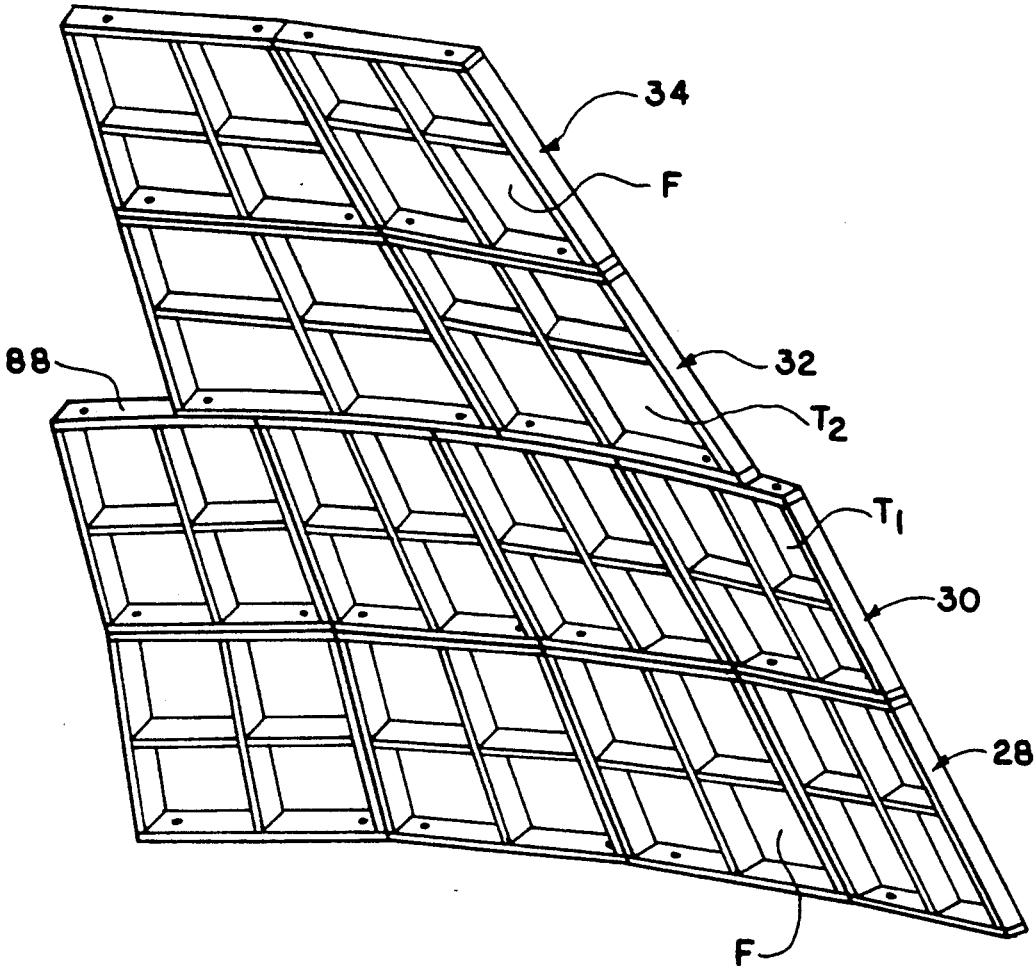
FIG. 6 is a prospective, interior view of four rings of segmental panels which can be used in construction of the structure shown in FIG. 1.

The features of transitional panels $T_1$ and $T_2$ are best illustrated in FIGS. 6, 12, 13 and 13A. In this respect, FIG. 6 shows a perspective interior view of portions of four rings of panels. The uppermost ring 34 and lowermost ring 28 being formed to plat panels F and the innermost rings 30, 32 being comprised of transitional panels $T_1$, $T_2$.

Figure 12:
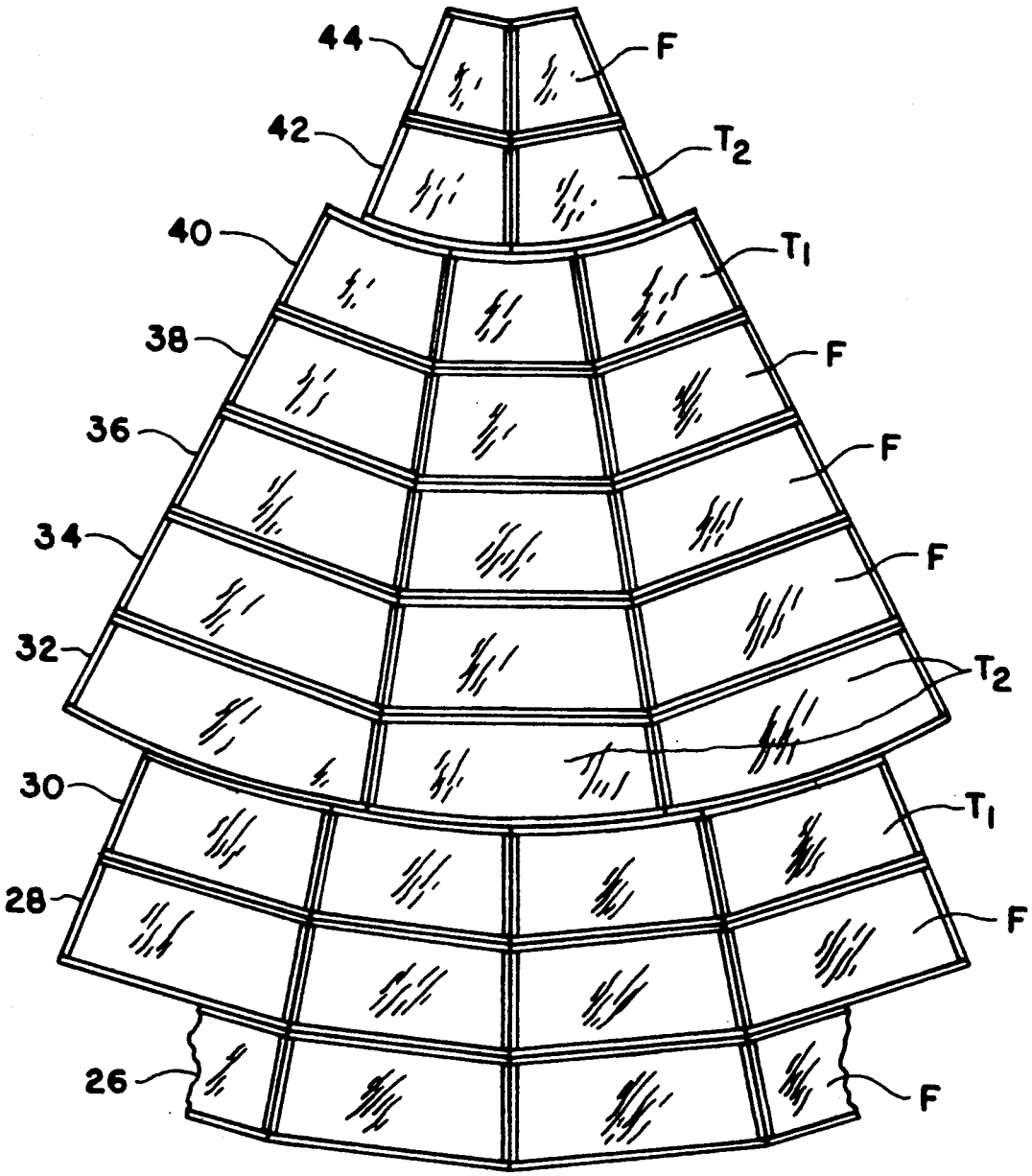
FIG. 12 is an elevational view of several rings of the panel (all of the panels lying in the plane of the drawing sheet)
Figure 13:
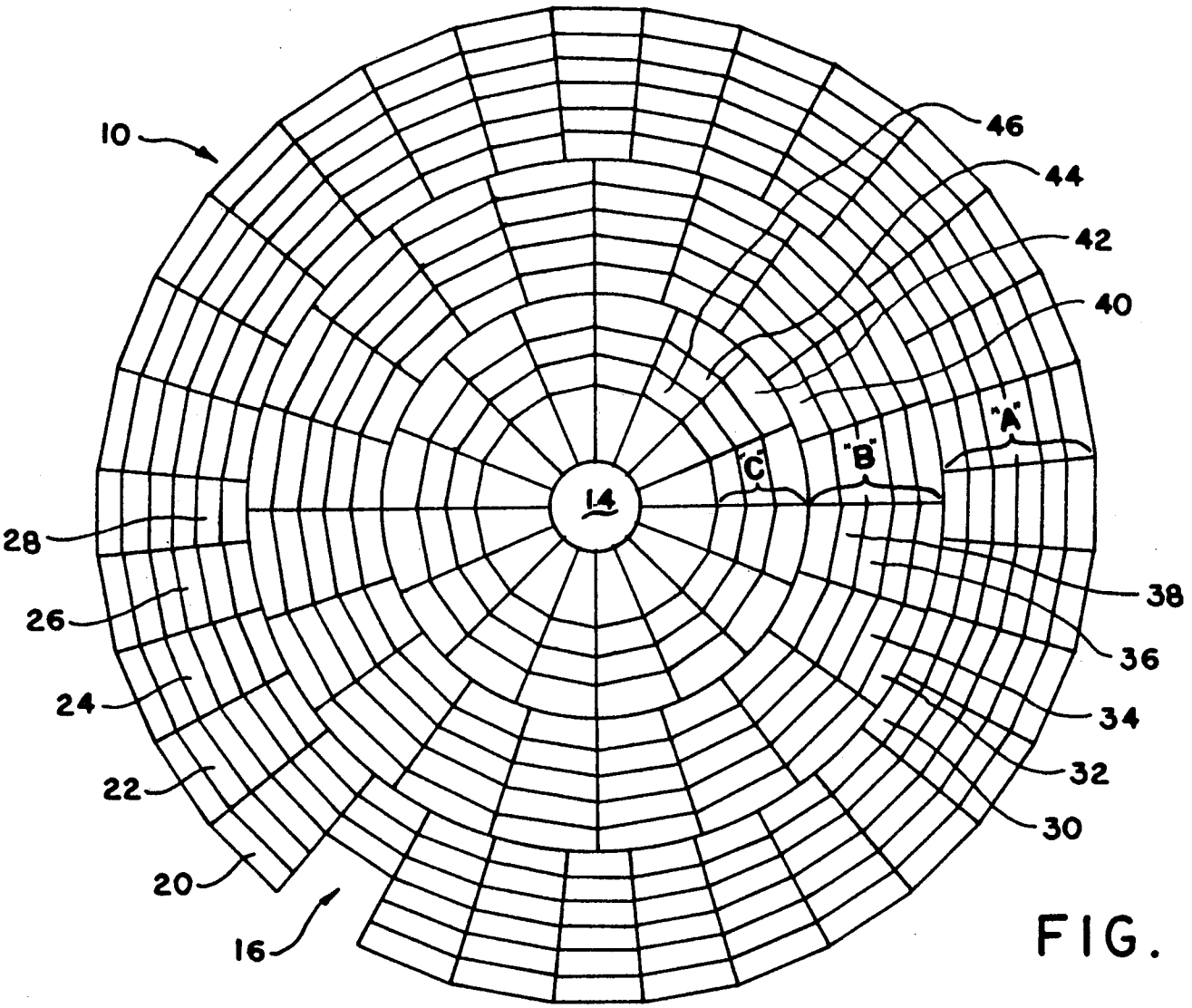
FIG. 13 is a top plan view of the self supporting structure shown in FIG. 1.

As illustrated in FIG. 6, the vertical alignment of the sides of the panels in rings 28 and 30, need not be continued in ring 32. Because ring 32 is formed from transitional panels $T_2$ and has a downward facing conical surface dimensioned to mate with annular conical surface 88 defined by transitional panels $T_1$ of ring 30, panels in ring 32 may be larger than those in ring 30 and may be offset from those below. In this respect, FIG. 12 is an elevational view for a portion of rings in sets "A", "B" and "C" with all the panels shown lying in the plane of the drawing sheet. FIG. 12 more clearly illustrates the faceted interface between the upper and lower end of flat panels F and the conical interface between transitional panels $T_1$ and $T_2$. FIG. 12 also illustrates how higher rings in structure 10 have fewer panels which in some instances are larger in size than panels in rings below. In this respect, FIG. 13 is a top plan view of structure 10 shown in FIGS. 1 and 2. FIG. 13 illustrates how the panels in contiguous sets "A", "B" and "C" are dimensioned to progressively reduce the number of panels in sets "B" and "C". In the embodiment shown, each ring in set "A" includes, or is dimensioned to include 32 panels, where as the rings in set "B", each include 20 panels and the rings in set "C" each include 16 panels. Thus, a structure 10 according to the present invention includes substantially fewer panels than an equivalent-sized structure comprised solely of flat panels, thereby reducing the costs of the structure by reducing the fabrication cost and by maximizing utilization of construction materials.

Figure 13A:
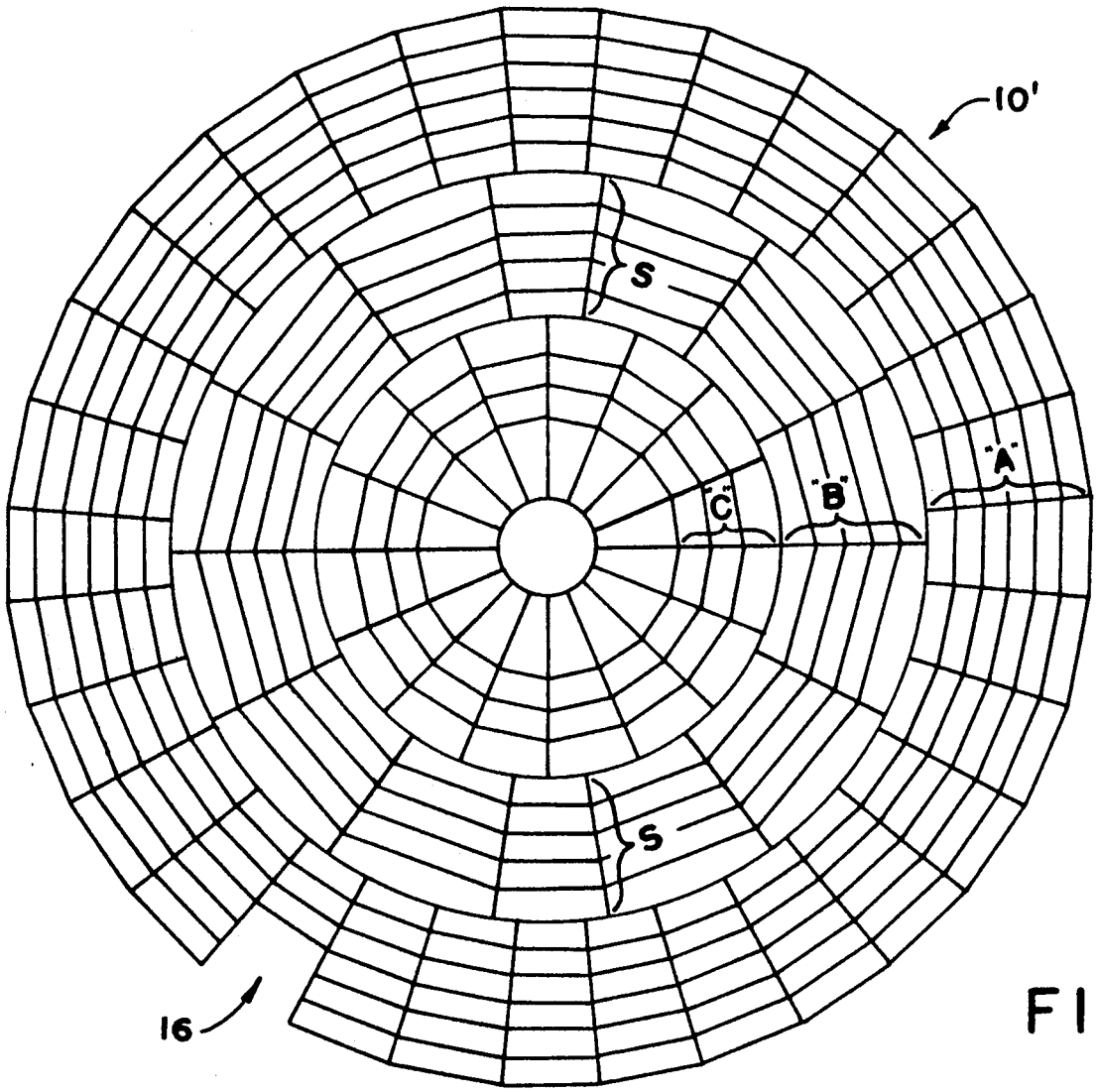
FIG. 13A is a top plan view of a self supporting structure illustrating another embodiment of the present invention.

FIG. 13A shows structure 10' which is a variation of structure 10 shown in FIG. 13. Structure 10' includes three contiguous sets "A'", "B'" and "C'" of rings. Set "B" is comprised of a plurality of rings, wherein each ring is comprised of panels of two different sizes. As shown in FIG. 13A, set "B" includes two sectors, designated "S" in the drawing on opposite sides of structure 10' which are formed of panels which are narrower than other panels in a given ring. FIG. 13A illustrates how, in a given set, one or more panels in each ring can be utilized as a "filler" panel or "spacer" panel to complete a given ring so as to permit other panels in a ring to be of maximum shape for full utilization of standard construction material or to avoid complex calculation of measurements. In other words, panels in a given ring can be dimensioned for ease of fabrication, and a spacer panel can be used to fill in any undersized gap in the ring.

Figure 14:
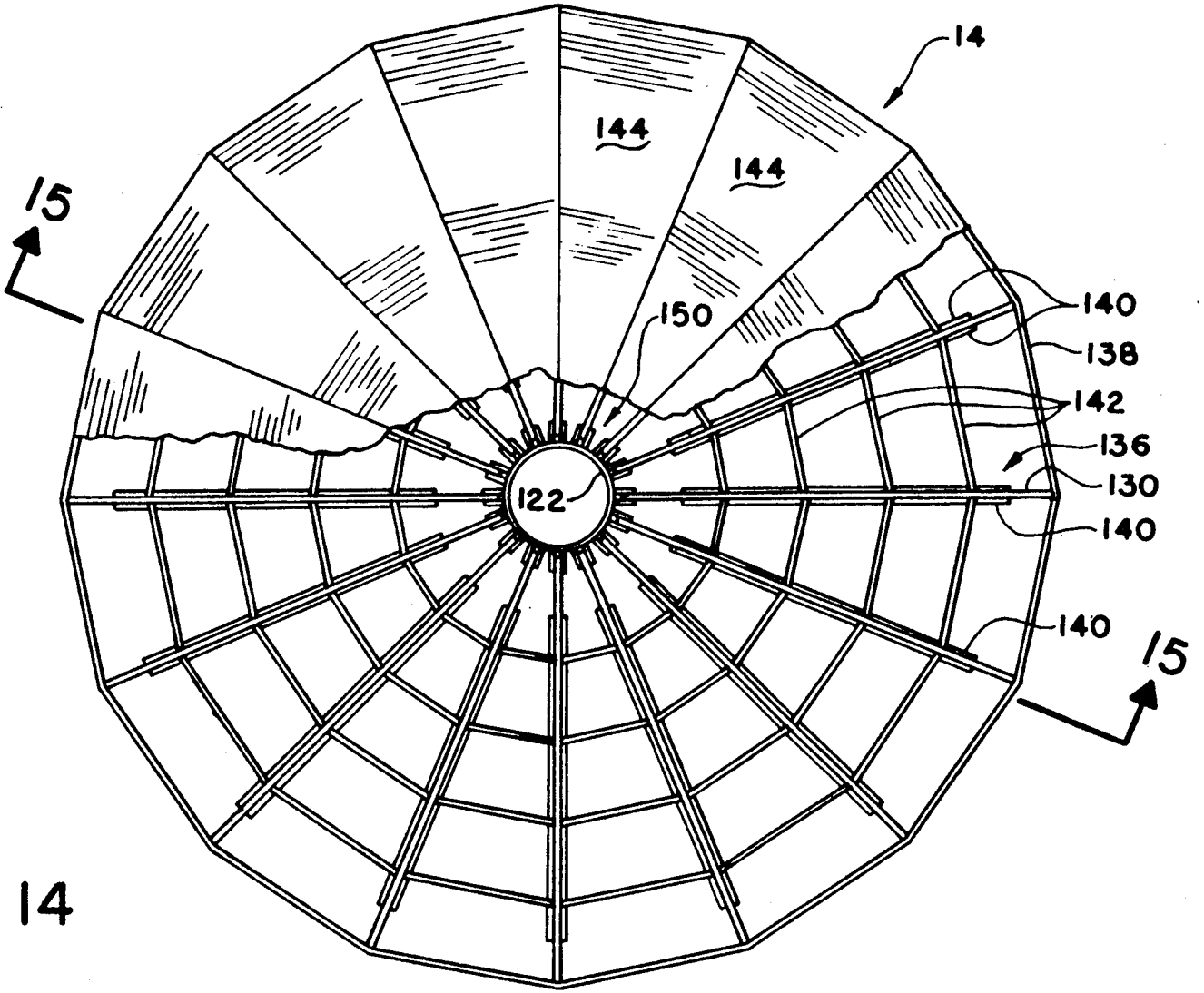
FIG. 14 is a top plan view of a cover assembly according to another aspect of the present invention.
Figure 15:
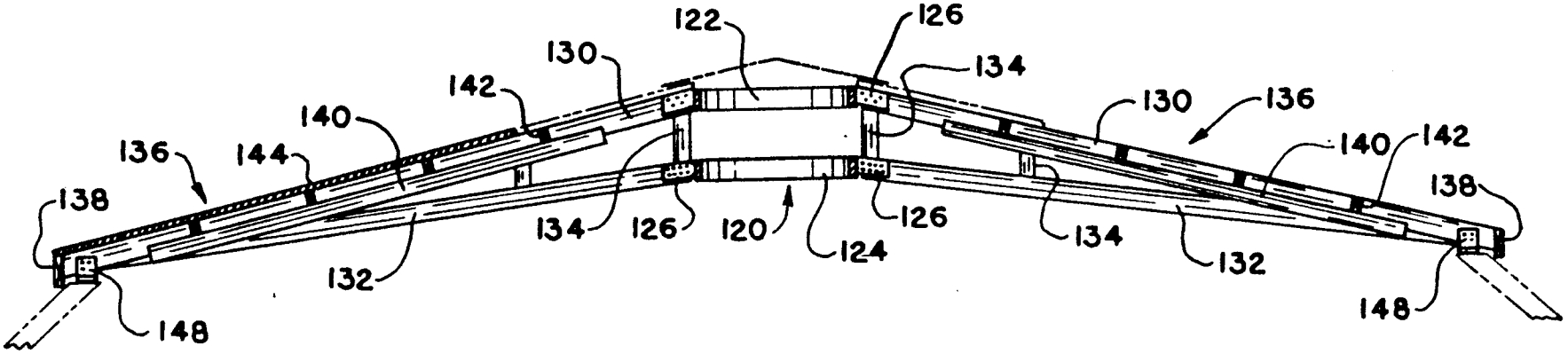
FIG. 15 is a sectional view taken along lines 15—15 of FIG. 14.
Figure 15A:
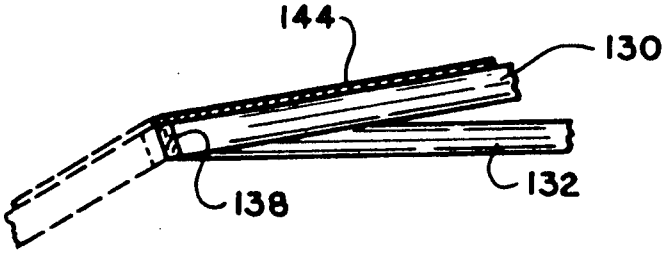
FIG. 15A is a view of the outer edge of a cover illustrating another embodiment thereof.

Referring now to FIGS. 14, 15 and 15A, cover 14 is shown. Cover 14 is provided to complete the peak of structure 10 and is basically comprised of a hub 120 formed from two spaced apart rings 122, 124. Each ring includes a plurality of plates 126 arranged in pairs which are equally-spaced about the periphery of rings 122, 124 and extend radially outwardly therefrom. Rings 122, 124 and plates 26 are preferably formed of metal and are joined to each other by conventional welding techniques. Rings 122 and 124 have equal numbers of pairs of plates 126 which are positioned such that plates 126 on ring 122 are in registry with plates 126 on ring 124 when ring 122 is positioned above ring 124. Plates 126 in each pair are spaced apart and parallel to each other to define an opening therebetween which is dimensioned to receive one end of an elongated rectilinear member. A plurality of elongated upper beams 130 extend radially outward from upper ring 122. As best seen in FIG. 15, beams 130 and plates 126 are oriented at a downward angle relative to ring 122. Holes 128 are provided in plates 126 to receive conventional threaded fasteners which fixedly secure the ends of beams 130 to plates 126. A plurality of lower beams 132 positioned below beams 130 extend from ring 124. As seen in FIG. 15, beams 132 and plates 126 of ring 124 are oriented at an angle which is shallower than beam 130 such that the ends of beams 130 and 132 intersect. The upper edge of the end of beam 132 is preferably beveled to form a tight joint with beam 130, and the ends of beams 130 and 132 are secured together, preferably by gluing and nailing. A plurality of vertical posts 134 are fastened to beams 130, 132. Together beams 130, 132 and posts 134 create a plurality of individual trusses 136 which radiate outwardly from rings 122, 124. The ends of each truss 136 are connected by an end plate 138. Each truss 136 includes ledger strips 140 on each side thereof, which ledger strips 140 support a plurality of purlins 142 which extend from truss to truss and which are positioned such that their upper surfaces are co-planar with the upper surfaces of beams 130. Panels 144 of sheet material, such as plywood or fiberglass, are secured to beams 130 and purlins 142. A conical dome cap 146 (shown in phantom in FIG. 15) is preferably provided to cover the opening defined by rings 122, 124. In the embodiment shown in FIGS. 10 and 11, cover 14 is dimensioned to be fastened to the uppermost ring by a clip angle 148 having holes in each leg thereof to receive standard threaded fastener therethrough. One leg of clip angle 148 is fastened to beam 130 and the other leg is secured to the upper plate members of the panels forming the upper ring. FIG. 15A shows another embodiment of cover 14 wherein end plate 138 has been oriented to mate with the upper plate member of an adjacent panel (shown in phantom) wherein end plate 138 may be secured to the upper plate member of the panel by a threaded fastener extending therethrough.

According to the present invention, cover 14 is designed and dimensioned to complete the upper end of structure 10. In this respect, cover 14 eliminates the numerous small panels typically found at the upper end of such structures, which panels are relatively costly and time consuming to fabricate and erect, and which do not efficiently utilize the size of standard construction material.

The present invention as heretofore described, thus provides a self supporting dome structure 10 which substantially reduces the number of panels in dome structures formed of flat panels, yet is more economical in fabrication costs than other self-supporting dome structures. The present invention permits substantially larger flat panel domes to be constructed, and at the same time facilitates maximum utilization of standard construction material.

While the present invention has been described with reference to preferred embodiments, modifications and alterations will occur to those skilled in the art upon a reading and understanding of the specification. It is intended that all such modifications and alterations be included insofar as they come within the scope of the appended claims of equivalents thereof.

Having thus described the invention, the following is claimed:

1. A self supporting dome structure comprised of:

a plurality of rings connected one upon another, each of said rings approximating a conical frustum with successively higher rings having lower angles of inclination, and some of said rings formed of a plurality of individual, flat panels secured side-to-side, each of which includes a flat rectilinear top plate member, a flat rectilinear bottom plate member and opposed flat rectilinear side members, said side member converging inwardly from said bottom member to said top member, at least one first transitional ring having a plurality of panels secured side-to-side, each panel of said transitional ring including upwardly converging rectilinear side members, a concave top plate member defining an upper conical surface which slopes inwardly, and a flat rectilinear bottom plate, and at least one second transitional ring having a plurality of panels secured side-to-side, each panel of said second transitional ring including upwardly converging rectilinear side members, a flat rectilinear top plate member and a convex bottom member defining a lower conical surface which slopes inwardly.

2. A structure as defined in claim 1 wherein said second transitional ring contains fewer panels than said first transitional ring.

3. A structure as defined in claim 2 wherein each of said panels in said first transitional ring are substantially equal in dimension.

4. A structure as defined in claim 2 wherein at least one of said panels in said first transitional ring includes a top plate member and a bottom plate member which are shorter than top and bottom plate members in other panels in said ring.

5. A structure as defined in claim 1 wherein said rings are arranged in contiguous sets of rings, each ring in a set comprising the same number of panels, and each ring of a set including a greater number of panels than the rings of the set thereabove.

6. A structure as defined in claim 5 wherein each contiguous set includes a first transitional ring and a second transitional ring, said first transitional ring being the uppermost ring in said contiguous set and said second transitional ring being the lowermost ring in said contiguous set.

7. A structure as defined in claim 5 wherein each panel in a ring is generally identical.

8. A self supporting structure comprising:

a plurality of vertically-adjacent, upwardly and inwardly inclining rings stacked one on another, each ring being generally circular and comprised of a plurality of horizontally-adjacent panels;

said rings arranged in contiguous sets, each ring in a set comprising the same number of panels and including at least a first transitional ring at the uppermost end thereof or a second transitional ring at the lowermost end thereof, each of said panels in said first transitional ring having a rectilinear bottom plate, opposed rectilinear side members converging inwardly from said bottom member, and a concave top plate member defining a conical surface, said top plate members of said first transitional ring defining a generally upward facing annular conical surface, which slopes inwardly and downwardly wherein the apex of said conical surface coincides with the axis of said structure, said second transitional ring having a rectilinear top plate member, opposed rectilinear side member converging inwardly toward top plate member, and a convex bottom plate member defining a conical surface, said bottom plate members of said second transitional ring defining a generally downward facing annular conical surface which slopes inwardly and downwardly wherein the apex of said annular conical surface coincides with the axis of said structure, said upward facing annular surface of said first transitional ring dimensioned to mating engage a downward facing annular surface of a second transitional ring of the contiguous set of rings thereabove and said downward facing annular conical surface of said second transitional ring dimensioned to matingly engage an upward facing annular conical surface of a first transitional ring of the contiguous set of rings therebelow.

9. A structure as defined in claim 8 wherein at least one of said contiguous set of rings further comprises intermediate rings between said first and second transitional rings, said intermediate rings including a plurality of flat panels comprised of a rectilinear top plate member, a rectilinear bottom plate member and opposed rectilinear side members which converge inwardly from said bottom plate member to said top plate member.

10. A structure as defined in claims 8 or 9 wherein the panels in a ring are generally identical, and each is an aliquot of the ring.

11. A self-supporting dome structure comprising:

a plurality of vertically adjacent, upwardly and inwardly inclining, generally annular rings stacked one on another, said rings including:

a first group of rings comprised of a predetermined number of horizontally-adjacent flat panels, each panel comprised of a rectilinear to plate member, a rectilinear bottom plate member, and opposed rectilinear side members converging inwardly from said bottom plate member to said top plate member, a second group of rings above said first set of rings, said second set of rings being smaller in diameter than said first group of rings and having a lesser number of horizontally adjacent flat panels, each panel comprised of a rectilinear top plate member, a rectilinear bottom plate member, and opposed rectilinear side members converging inwardly from said bottom plate member to said top plate member, and a pair of first and second transitional rings disposed between said first group of rings and said second group of rings, said first transitional ring comprised of horizontally-adjacent panels equal in number to the panels in a ring in said first group of rings and having a generally upward facing annular surface, each panel in said first transitional ring including a rectilinear bottom plate member, opposed side members which converge inwardly from said bottom plate member, and a concave top plate member defining a conical surface, said second transitional ring comprised of horizontally-adjacent panels equal in number to the panels in a ring in said second group of rings, and having a generally downward facing annular surface dimensioned and oriented to engage said annular surface on said first transitional ring.

12. A self supporting dome structure comprising:

a plurality of vertically adjacent, upwardly and inwardly inclining, generally annular rings stacked one on another, said rings including, a first group of rings comprised of a predetermined number of horizontally-adjacent flat panels, each panel comprised of a rectilinear top plate member, a rectilinear bottom plate member, and opposed rectilinear side members converging inwardly from said bottom plate member to said top plate member, a second group of rings above said first set of rings, said second set of rings being smaller in diameter than said first group of rings and having a lesser number of horizontally adjacent flat panels, each panel comprised of a rectilinear top plate member, a rectilinear bottom plate member, and opposed rectilinear side members converging inwardly from said bottom plate member to said top plate member, and a pair of first and second transitional rings disposed between said first group of rings and said second group of rings, said first transitional ring comprised of horizontally-adjacent panels equal in number to the panels in a ring in said first group of rings and having a generally upward facing annular surface, said second transitional ring comprised of horizontally-adjacent panels equal in number to the panels in a ring in said second group of rings, and having a generally downward facing annular surface dimensioned and oriented to engage said annular surface on said first transitional ring, each panel in said second transitional ring including a rectilinear top plate member, upwardly converging rectilinear side members and a convex bottom plate member defining a conical surface.

13. A structure as defined in claims 11 or 12 wherein the panels in a specific ring of said structure are equal in size.

14. A structure as defined in claim 11 or 12 wherein each panel in a transitional ring are equal in size to other panels in such transitional ring.

15. A self supporting structure comprised of:

a plurality of vertically-adjacent, upwardly and inwardly inclining rings stacked one on another; each ring being generally circular and comprised of a plurality of horizontally-adjacent similar panels, and each panel being disposed with its sides laterally staggered with respect to the sides of the panels in the ring above and below, at least one of said rings including identical flat panels, each having a rectilinear top plate member, a rectilinear bottom plate member and opposed rectilinear side members which converge inwardly from said bottom plate member to said top plate member, at least one of said rings including identical panels each having a rectilinear top plate, upwardly converging rectilinear side members and a convex bottom plate member defining a generally downward facing conical surface wherein said panel in said ring define an annular conical surface which slopes inwardly and downwardly such that the apex of said annular conical surface coincides with the axis of said structure, and at least one of said rings including identical panels each having a rectilinear bottom plate, upwardly converging rectilinear said members and a concave top plate member defining a generally upward facing conical surface wherein said panels in said ring define an annular conical surface which slopes inwardly and downwardly such that the apex of said annular conical surface coincides with the axis of said structure.

* * * * *